US010183492B2

(12) United States Patent
Nose et al.

(10) Patent No.: US 10,183,492 B2
(45) Date of Patent: Jan. 22, 2019

(54) DETACHABLE BODY FOR PRINTING APPARATUS

(71) Applicant: Seiko Epson Corporation, Tokyo (JP)

(72) Inventors: Hiroshi Nose, Shiojiri (JP); Yuji Aoki, Hara (JP); Noboru Otsuki, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/425,160

(22) Filed: Feb. 6, 2017

(65) Prior Publication Data

US 2017/0246875 A1 Aug. 31, 2017

(30) Foreign Application Priority Data

Feb. 25, 2016 (JP) ..... 2016-034085

(51) Int. Cl.
*B41J 2/14* (2006.01)
*B41J 2/175* (2006.01)

(52) U.S. Cl.
CPC ..... *B41J 2/17526* (2013.01); *B41J 2/14072* (2013.01); *B41J 2/1752* (2013.01); *B41J 2/17509* (2013.01); *B41J 2/17513* (2013.01); *B41J 2/17546* (2013.01); *B41J 2/17553* (2013.01)

(58) Field of Classification Search
CPC ... B41J 2/17526; B41J 2/1752; B41J 2/14072
See application file for complete search history.

(56) References Cited

U.S. PATENT DOCUMENTS 6,554,394 B1 * 4/2003 Yamaguchi ..... B41J 2/1714 347/37
8,616,686 B2 * 12/2013 Takagi ..... B41J 2/1753 347/19
8,616,687 B2 * 12/2013 Takagi ..... B41J 2/1753 347/86
2002/0015067 A1 * 2/2002 Studholme ..... B41J 2/17503 347/19

(Continued)

FOREIGN PATENT DOCUMENTS

JP 2002-001979 A 1/2002
JP 2006-168377 A 6/2006

(Continued)

*Primary Examiner* — Anh T. N. Vo
(74) *Attorney, Agent, or Firm* — Harness, Dickey & Pierce, P.L.C.

(57) ABSTRACT

A detachable body for a printing apparatus enables positioning a board for electrical connection to a printing apparatus, while also reducing manufacturing cost. The detachable body for a printing apparatus includes a case that is mounted to and detached from a printing apparatus that performs printing on a sheet, and a board that is attached to an attachment surface that is a surface of the case, and that is electrically connected to the printing apparatus by coming into contact with detachable body-side contacts provided on the printing apparatus when the case is mounted to the printing apparatus. The attachment surface of the case is provided with an attaching portion to which the board is attached. The attaching portion surrounds the board and positions the board in a direction along the attachment surface of the case by coming into contact with peripheral edges of the board.

18 Claims, 8 Drawing Sheets

(56) References Cited

U.S. PATENT DOCUMENTS

| | | | | |
|---|---|---|---|---|
| 2003/0071874 | A1 | 4/2003 | Ishizawa et al. | |
| 2003/0156160 | A1* | 8/2003 | Yamaguchi | B41J 2/14 347/58 |
| 2005/0146576 | A1 | 7/2005 | Shinada et al. | |
| 2007/0222838 | A1* | 9/2007 | Wanibe | B41J 2/17526 347/86 |
| 2013/0050359 | A1* | 2/2013 | Kanbe | B41J 2/175 347/86 |
| 2013/0162729 | A1 | 6/2013 | Takagi et al. | |
| 2013/0162730 | A1 | 6/2013 | Takagi et al. | |
| 2014/0168324 | A1* | 6/2014 | Sasaki | B41J 2/17523 347/86 |
| 2015/0165781 | A1* | 6/2015 | Mizutani | B41J 2/1752 347/86 |

FOREIGN PATENT DOCUMENTS

| | | | |
|---|---|---|---|
| JP | 2013-129173 | A | 7/2013 |
| JP | 2013-129175 | A | 7/2013 |

* cited by examiner

DETACHABLE BODY FOR PRINTING APPARATUS

CROSS REFERENCE TO RELATED APPLICATION

This application claims priority to Japanese Patent Application No. 2016-034085 filed on Feb. 25, 2016. The entire contents of Japanese Patent Application No. 2016-034085 are incorporated by reference herein.

BACKGROUND

1. Technical Field

The present invention relates to a detachable body for a printing apparatus that is mounted to and detached from a printing apparatus when performing printing on a medium.

2. Related Art

One known example of a detachable body for a printing apparatus is an ink cartridge that can be mounted to and detached from an inkjet printer (printing apparatus), which performs printing with use of a liquid such as ink, and that can store ink that is to be supplied to the printer. Some of such ink cartridges are capable of exchanging information with a printer, such as the type, remaining amount, and expiration date of the stored ink. JP-A-2002-1979 discloses an ink cartridge that includes a circuit board capable of being electrically connected to a terminal mechanism provided in a printer.

JP-A-2002-1979 is an example of related art.

It should be noted that with an ink cartridge that is electrically connected to a printer as in JP-A-2002-1979, it is very important for the circuit board provided on the ink cartridge to be positioned so as to maintain favorable contact with the terminal mechanism of the printer. For this reason, in the ink cartridge disclosed in JP-A-2002-1979, the circuit board is attached to one of the surfaces of the ink cartridge case and is positioned by two projections that protrude from the case.

However, in order for the circuit board to be positioned by the two projections provided on the case, the circuit board needs to be provided with through-holes or notches for engaging with the projections, and manufacturing cost therefore rises.

SUMMARY

An advantage of some aspects of the invention is providing a detachable body for a printing apparatus that enables positioning a board for electrical connection to a printing apparatus, while also reducing manufacturing cost.

The following describes means for solving the above issues, and actions effects of such means.

A detachable body for a printing apparatus according to an aspect of the invention includes: a case that is mounted to and detached from a printing apparatus that performs printing on a medium; and a board that is attached to an attachment surface that is a surface of the case, and that is electrically connected to the printing apparatus by coming into contact with a contact provided on the printing apparatus in a state where the case is mounted to the printing apparatus, wherein the attachment surface of the case is provided with an attaching portion to which the board is attached, and the attaching portion is provided so as to surround the board, and positions the board in a direction along the attachment surface of the case by coming into contact with a peripheral edge of the board.

According to this configuration, the board can be positioned on the case without providing the board with a through-hole or a notch. Accordingly, it is possible to position the board for electrical connection to the printing apparatus, while also reducing manufacturing cost.

It is preferable that in the above detachable body for a printing apparatus, the attaching portion is a recessed portion that is recessed from the attachment surface of the case, and the board is attached so as to be surrounded by inner peripheral surfaces of the recessed portion.

According to this configuration, the board can be positioned by merely fitting the board into the attaching portion that is a recessed portion.

It is preferable that in the above detachable body for a printing apparatus, a projection that protrudes in a direction along the attachment surface is provided on an inner peripheral surface of the recessed portion.

According to this configuration, the projection positions the board, thus making it possible to improve the ease of attachment of the board in comparison with a configuration in which the board is positioned by the entirety of an inner peripheral surface of the attaching portion that is a recessed portion.

It is preferable that in the above detachable body for a printing apparatus, the attachment surface is a surface that extends along a mounting direction in which the case is mounted to the printing apparatus, and the attaching portion is provided at a position that is toward a front side in the mounting direction on the attachment surface.

According to this configuration, in comparison with a configuration in which the attaching portion is provided at a position toward the rear side in the mounting direction on the attachment surface, in the above configuration, the attachment surface of the case comes into contact with the contact provided on the printing apparatus over a shorter distance when the case is mounted to the printing apparatus. In other words, it is possible to reduce the load when the case is mounted to the printing apparatus.

It is preferable that in the above detachable body for a printing apparatus, the attaching portion is provided with a protrusion portion that protrudes in a direction along the attachment surface so as to cover at least a portion of an upper surface of the board.

According to this configuration, the risk of the board falling out of the attaching portion can be reduced by the protrusion portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

A detachable body for a printing apparatus of the invention will be described below with reference to the drawings by way of example of an ink cartridge that is mounted to and detached from an inkjet printer (printing apparatus) that performs printing on a medium with use of ink.

Figure 1:
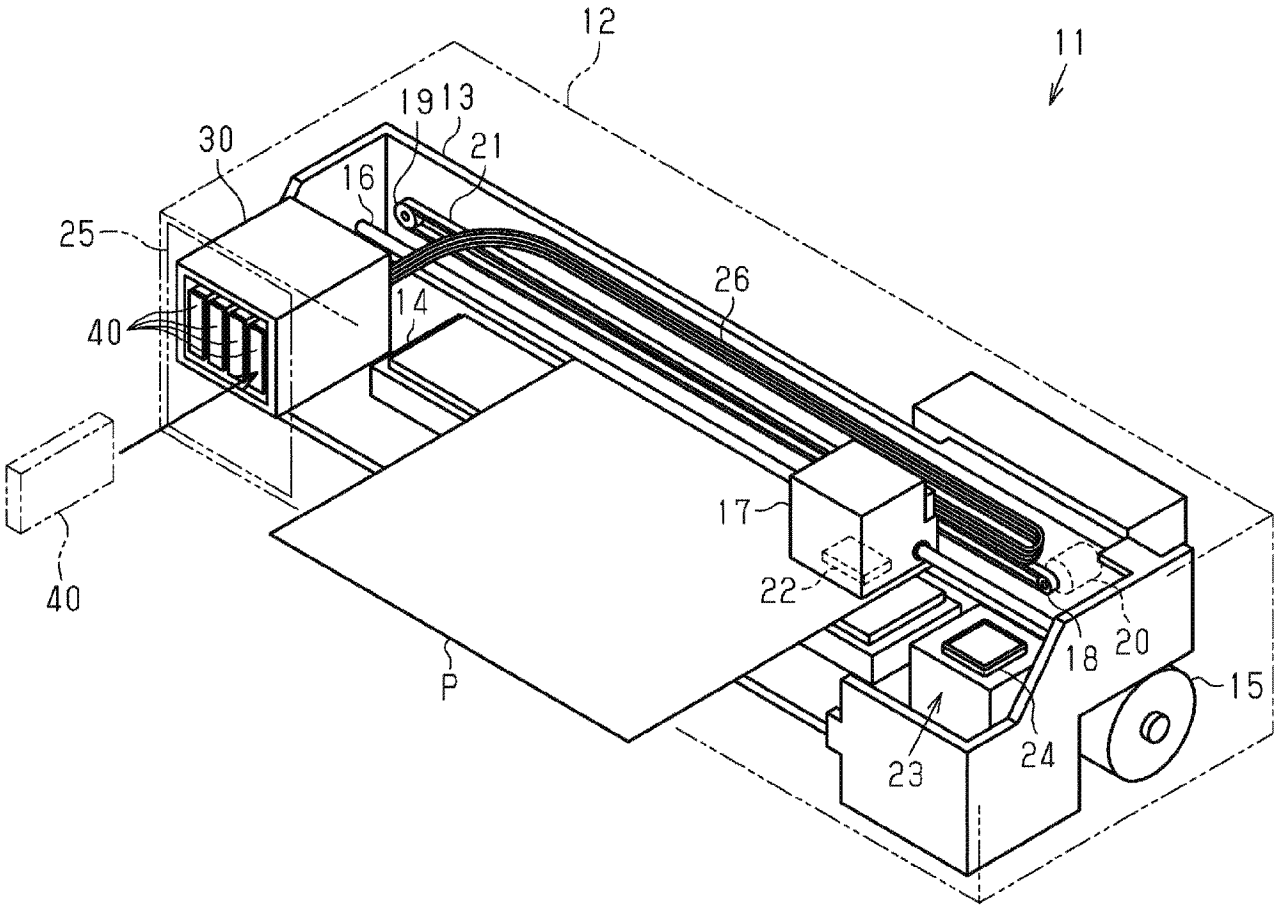
FIG. 1 is a perspective view of an internal structure of a printing apparatus to and from which an ink cartridge according to an embodiment can be mounted and detached.

As shown in FIG. 1, a printing apparatus 11 includes a cuboid casing 12. A rectangular box-shaped frame 13 is stored in the casing 12, a support platform 14 that supports sheets P (one example of a medium) from below is provided below the frame 13, and a conveying motor 15 is provided in the casing 12 in order to drive a conveying mechanism (not shown) that conveys the sheets P along the support platform 14. The support platform 14 is elongated in the lengthwise direction of the printing apparatus 11 (the left-right direction in FIG. 1). When a sheet P is conveyed by the driving of the conveying motor 15, it is conveyed along a direction that intersects the lengthwise direction of the printing apparatus 11. In other words, the direction that intersects the lengthwise direction of the printing apparatus 11 is the conveying direction in which the sheet P is conveyed. When the sheet P is conveyed along the conveying direction, it is conveyed from the inside of the casing 12 to the outside of the casing 12 via the surface of the casing 12 that faces leftward and forward. In other words, in the printing apparatus 11 of this embodiment, the front surface side of the printing apparatus 11 is considered to be the downstream side in the conveying direction, and the back surface side of the printing apparatus 11, which is the opposite side, is considered to the upstream side in the conveying direction.

Inside the casing 12, a circular column-shaped guide shaft 16 spans opposing sides of the frame 13 above the support platform 14. The guide shaft 16 is longer than the support platform 14 in the lengthwise direction of the printing apparatus 11, and supports a carriage 17 that is capable of moving back and forth along the guide shaft 16. Also, a driving pulley 18 and a driven pulley 19 are attached to the inward surface of the back wall of the frame 13, which is on the back surface side of the printing apparatus 11, and are capable of rotating relative to the frame 13. The driving pulley 18 and the driven pulley 19 are arranged at respective ends of the frame 13 in the lengthwise direction of the printing apparatus 11. In this embodiment, the driving pulley 18 is arranged at a position on the right side in FIG. 1, and the driven pulley 19 is arranged at a position on the left side.

The driving pulley 18 is coupled to an output shaft of a carriage motor 20 that is provided on the outward surface of the back wall of the frame 13. In other words, the driving pulley 18 is driven to rotate by the driving of the carriage motor 20. An endless timing belt 21 is wound around the driving pulley 18 and the driven pulley 19, and is partially coupled to the carriage 17. Due to the timing belt 21, the driven pulley 19 is driven to rotate in accordance with the rotation of the driving pulley 18. Also, due to the timing belt 21 moving by the rotation of the driving pulley 18, the carriage 17 is moved along the guide shaft 16. In other words, due to the driving of the carriage motor 20, the carriage 17 scans over the sheet P that is supported by the support platform 14. In this embodiment, the lengthwise direction of the printing apparatus 11 is considered to be the scanning direction of the carriage 17, and this scanning direction intersects the conveying direction of the sheet P.

A head 22 that can discharge ink is built into the carriage 17. The head 22 discharges ink from a discharge surface, which is the lower surface, so as to print an image including characters, a photograph, or the like on the sheet P supported by the support platform 14. In other words, due to the carriage 17 moving along the scanning direction, the head 22 can performing printing on approximately the entire range of the sheet P being conveyed.

A maintenance unit 23, which is for performing maintenance on the head 22 built into the carriage 17, is arranged at a position that is inside the casing 12 and adjacent to (on the right side in FIG. 1) the support platform 14 in the scanning direction. The maintenance unit 23 has a cap 24 that is open upward, a pump (not shown) that performs suction via the cap 24, and the like. The maintenance unit 23 performs maintenance on the head by covering the head 22, which opposes the maintenance unit 23, with the cap 24, and driving the pump while the head 22 is capped so as to suction the inside of the cap 24 with the pump. When the inside of the cap 24 that covers the head 22 is suctioned by the pump, ink is suctioned out from the head 22, thus restoring and maintaining the discharge properties of the head 22.

Also, a region that is inside the casing 12 and on the one end side in the scanning direction at which the maintenance unit 23 is located (the right side in FIG. 1) is considered to be the home position at which the head 22 waits while the printing apparatus 11 is not performing printing or the like. When the head 22 is located at the home position, it is capped by the cap 24 of the maintenance unit 23 in order to suppress the drying of the ink. Note that the term "capped" refers to the formation of a closed space that the discharge surface of the head 22 faces, by the cap 24 coming into contact with the discharge surface.

Also, a mounting portion 30, to and from which an ink cartridge (detachable body for a printing apparatus) 40 that stores ink can be mounted and detached, is arranged at a position that is inside the casing 12 and on the other side (left side in FIG. 1) in the scanning direction that is opposite to the one end side on which the maintenance unit 23 is positioned. In other words, it can be said that the ink cartridge 40 is provided so as to be able to be mounted to and detached from the printing apparatus 11. The mounting portion 30 is arranged on the front surface side of the printing apparatus 11, and can be accessed from outside of the casing 12 by opening a cover 25 that is provided on the front surface of the casing 12. In other words, the ink cartridge 40 can be mounted to and detached from the mounting portion 30 via an opening that is exposed by opening the cover 25.

Also, the mounting portion 30 enables the mounting of multiple ink cartridges 40, and four of such ink cartridges 40 can be mounted side-by-side in the scanning direction in this embodiment. The ink cartridges 40 mounted to the mounting portion 30 store ink of various colors, such as cyan, magenta, yellow, and black. The ink cartridges 40 are connected to the head 22 by tubes 26 that extend from the back surface of the mounting portion 30, thus making it possible to supply ink from the ink cartridges 40 to the head 22. Note that one tube 26 is provided for each of the ink cartridges 40, and the tubes 26 are routed in a collective manner inside the casing 12.

Figure 2:
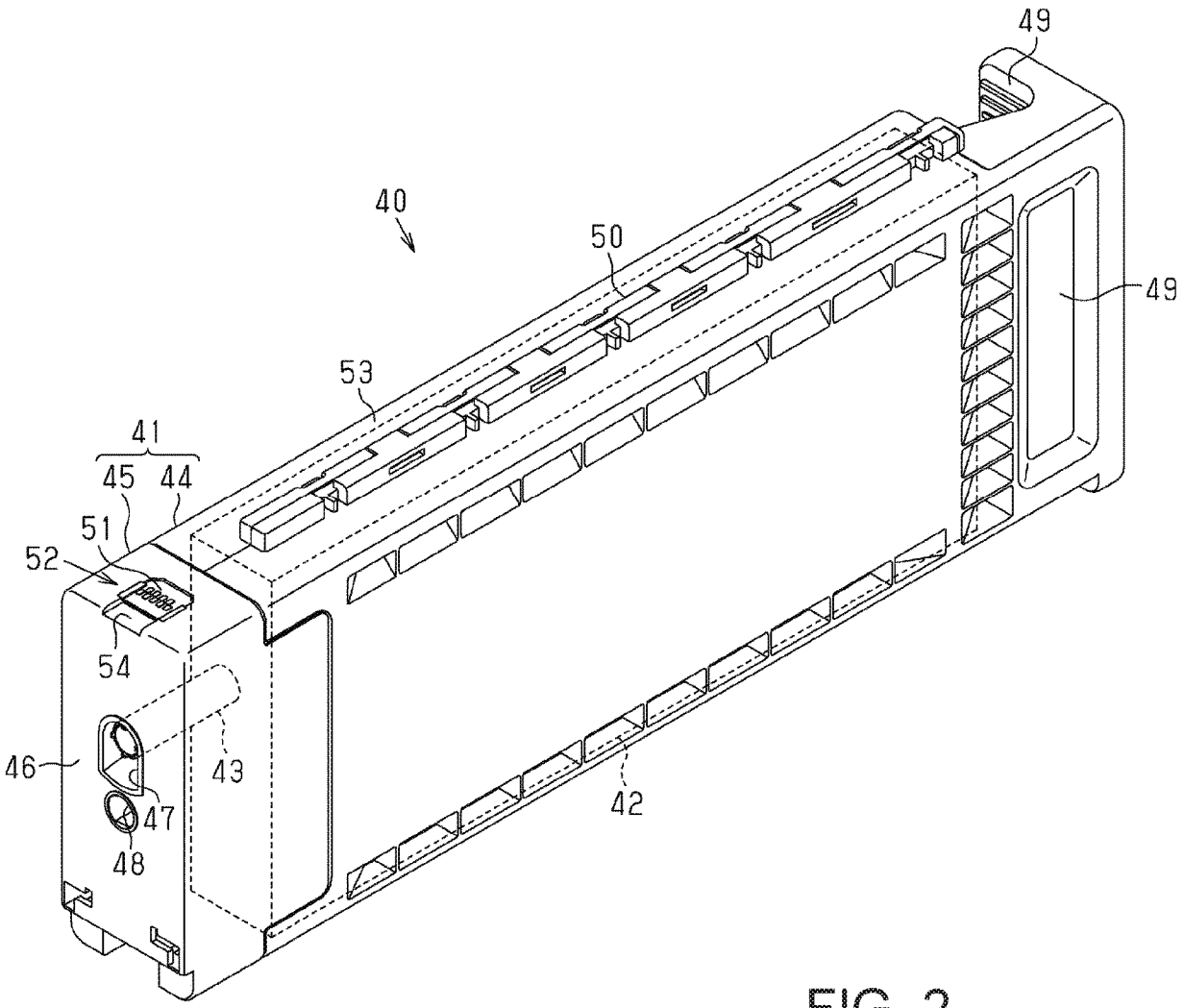
FIG. 2 is a perspective view of the ink cartridge.

As shown in FIG. 2, each ink cartridge 40 that is to be mounted to or detached from the printing apparatus 11 includes a case 41 that is cuboid and made of a resin, a storage portion 42 that can store ink, and a feeding portion 43 that can feed ink stored in the storage portion 42 to the outside of the case 41. In other words, the storage portion 42 and the feeding portion 43 are stored inside the case 41 and also protected by the case 41. The case 41 is elongated in the direction in which the case 41 is inserted into the mounting portion 30 when being mounted to the mounting portion 30, that is to say the mounting direction of the case 41. Note that in this embodiment, the side facing the leftward and forward direction in FIG. 2 is considered to be the front side in the mounting direction, and the opposite side is considered to be the rear side in the mounting direction. When the case 41 is mounted to the mounting portion 30, it is inserted into the mounting portion 30 beginning with the front side of the case 41.

The case 41 is constituted including a main case 44 that is elongated in the mounting direction, and a sub case 45 that is provided on the front side of the main case 44 in the mounting direction. In other words, the case 41 can be separated into the main case 44 and the sub case 45. A front surface 46 of the sub case 45 that constitutes the front portion of the case 41 in the mounting direction, and that is one of the surfaces of the case 41, is provided with a feeding hole 47 that is formed to expose the tip of the feeding portion 43 that extends from the storage portion 42, and a positioning hole 48 that is formed at a position directly below the feeding hole 47. The positioning hole 48 contributes to the positioning of the case 41 relative to the mounting portion 30 when the case 41 is mounted to the mounting portion 30, by receiving insertion of a rod (not shown) provided on the mounting portion 30, for example. Also, a handle 49 for facilitating holding of the case 41 is provided on the rear side of the case 41 in the mounting direction, that is to say the rear side of the main case 44.

A guide portion 50, which is for guiding the case 41 when the case 41 is mounted to the mounting portion 30, is provided on the upper surface of the main case 44, which is a portion of the upper surface of the case 41, and extends along the mounting direction. Also, a recessed portion, which is recessed one level from the upper surface of the sub case 45, is provided on the upper surface of the sub case 45 (specifically, at a position toward the front side in the mounting direction), which is a portion of the upper surface of the case 41, and a board 51 that can be electrically connected to the printing apparatus 11 is attached to the recessed portion. Specifically, the recessed portion provided in the upper surface of the case 41 is an attaching portion 52 to which the board 51 is attached, and the upper surface of the case 41 is an attachment surface 53 in which the attaching portion 52 is provided (i.e., to which the board 51 is attached).

The attachment surface 53 is a surface of the case 41 that extends along the mounting direction, and the board 51 is attached to the attaching portion 52 so as to extend along the attachment surface 53. Also, the board 51 can come into contact with a terminal connection portion (see FIGS. 6 and 7) 31 provided on the mounting portion 30 when the case 41 is mounted to the mounting portion 30. Specifically, by electrically connecting the ink cartridge 40 to the printing apparatus 11 via the board 51 and the terminal connection portion 31, the ink cartridge 40 can exchange various types of information with the printing apparatus 11, such as the type, remaining amount, and expiration date of the stored ink.

Figure 3:
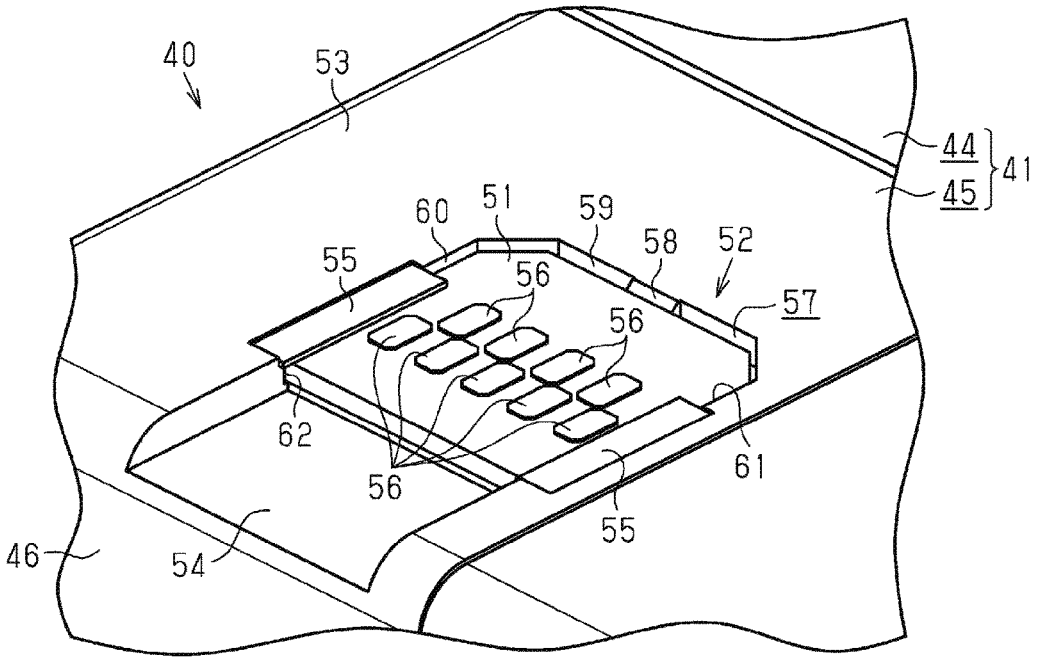
FIG. 3 is a perspective view of an attaching portion of the ink cartridge.

As shown in FIGS. 2 and 3, the attaching portion 52, which is a recessed portion, is provided at a position on the upper surface of the sub case 45 that is approximately central in both the mounting direction of the case 41 and the width direction of the case 41 that intersects the mounting direction. The attaching portion 52 is recessed so as to surround the board 51, and is recessed deeper than the thickness of the board 51 such that the board 51 is accommodated therein. A recessed groove portion 54 is provided in the attachment surface 53 at a position forward of the attaching portion 52 in the mounting direction, and the groove portion 54 is recessed from the front edge, which is at the front surface 46 of the sub case 45, and is continuous with the attaching portion 52. Note that the groove portion 54 has a smaller width than the attaching portion 52 in the width direction of the case 41. Specifically, when viewing the ink cartridge 40 from the front surface 46 side of the case 41 (the front side in the mounting direction), the board 51 attached to the attaching portion 52 can be seen through the groove portion 54. Also, when attached to the attaching portion 52, the board 51 cannot fall out through the groove portion 54.

The attaching portion 52 is also provided with protrusion portions 55 that protrude along the attachment surface 53 so as to cover portions of the upper surface of the attached board 51 (portions on respective sides in the width direction of the case 41). The protrusion portions 55 are provided at two locations that oppose each other in the width direction of the case 41, and lock the edges of the board 51 from above when accommodated in the attaching portion 52. In other words, the protrusion portions 55 are provided as eaves and suppress the case where the board 51 falls out of the attaching portion 52.

The board 51 that is to be attached to the attaching portion 52 is approximately rectangular, and the upper surface is provided with multiple terminals 56 for the exchange of information between the ink cartridge 40 and the printing apparatus 11. In this embodiment, nine terminals 56 are arranged in a zigzag manner in two lines extending along the width direction so as to not overlap each other in the mounting direction. The protrusion portions 55 that cover portions of the upper surface of the board 51 are provided at positions that do not overlap the terminals 56 on the board 51 when viewing the case 41 from above. Specifically, the board 51 attached to the attaching portion 52 is locked by the protrusion portions 55 at positions that do not overlap the terminals 56 in the mounting direction of the case 41 and are outward of the positions where the terminals 56 are provided in the width direction of the case 41. Note that the protrusion portions 55 are formed by heat-melting and pressing (heat crimping) portions of the sub case 45 (extension portions 63 shown in FIGS. 4 and 5) after the board 51 has been attached to the attaching portion 52.

Figure 4:
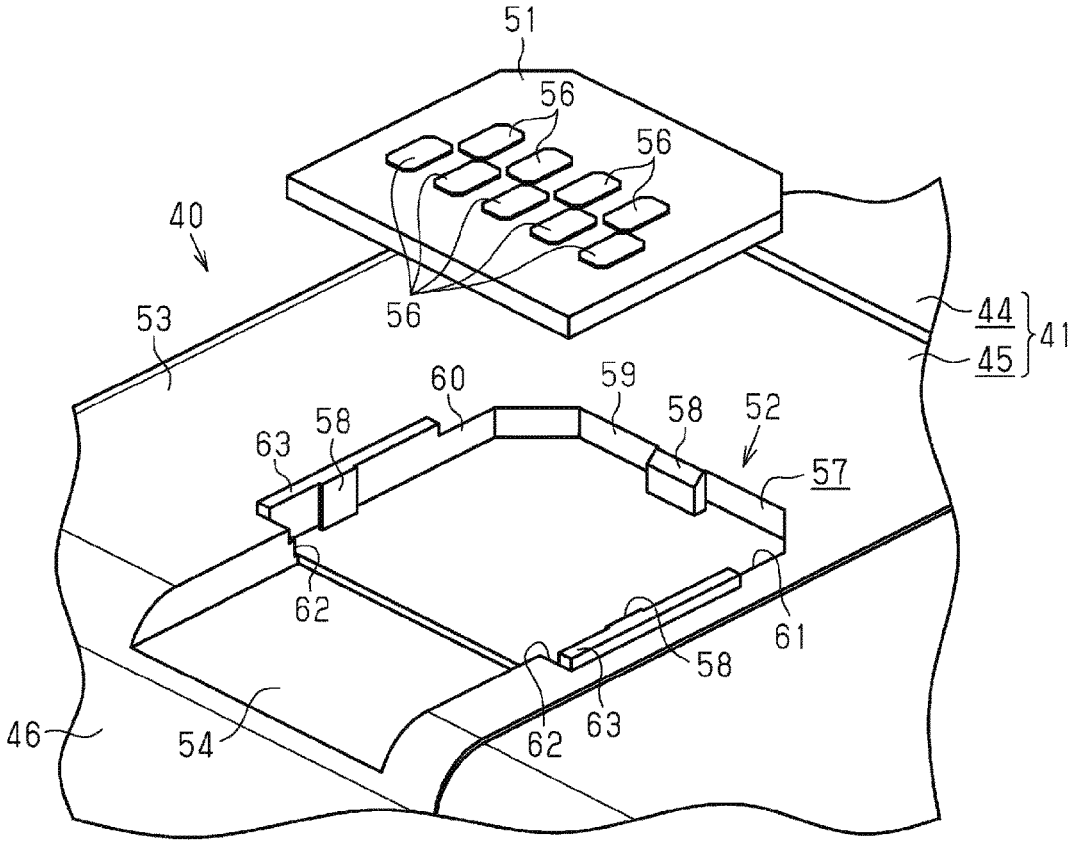
FIG. 4 is a perspective view of the ink cartridge and shows the attaching portion before a board is fitted therein.
Figure 5:
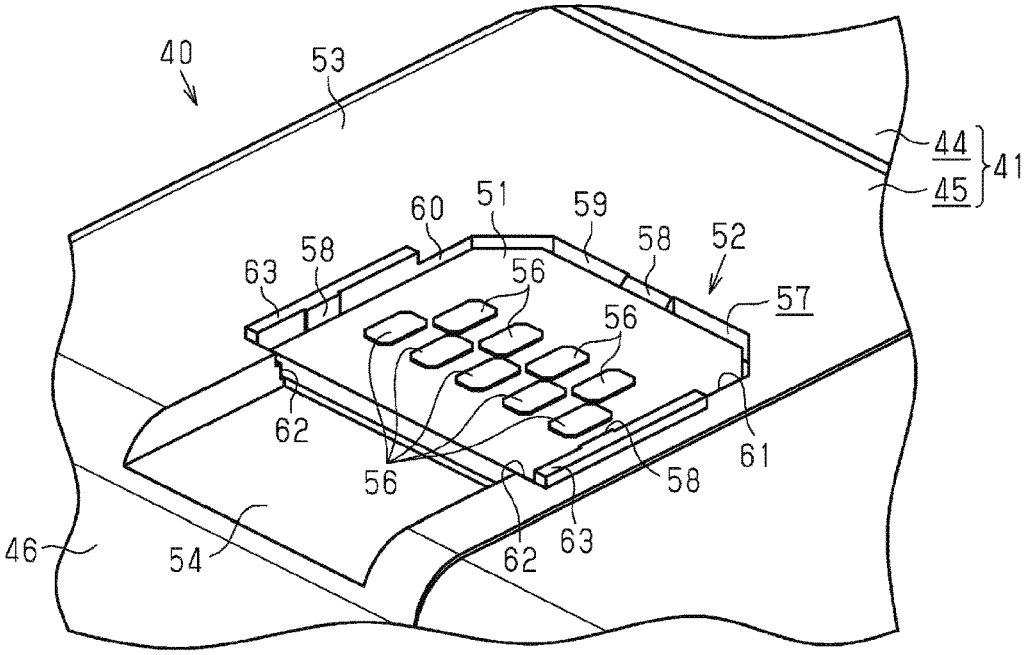
FIG. 5 is a perspective view of the ink cartridge and shows the attaching portion after the board is fitted therein.

As shown in FIGS. 4 and 5, the attaching portion 52 is recessed with approximately the same shape as the shape of the board 51 that is to be attached thereto, and is somewhat shallower than the groove portion 54. Also, multiple projections 58 that protrude toward the board 51 are provided on inner peripheral surfaces 57 of the attaching portion (recessed portion) 52 that come into contact with the peripheral edges of the board 51 fitted therein. Among the inner peripheral surfaces 57 of the attaching portion 52, the projections 58 of this embodiment are provided so as to protrude from a first surface 59 that is on the rear side in the mounting direction of the case 41, and a second surface 60 and a third surface 61 that oppose each other in the width direction of the case 41. When the board 51 is fitted into the attaching portion 52, it is accommodated in the attaching portion 52 in a state where portions of the peripheral edges are in contact with the three projections 58. Specifically, the projections 58 are considered to be portions of the inner peripheral surfaces 57 of the attaching portion 52, and portions of the inner peripheral surfaces 57 of the attaching portion 52 are in contact with the peripheral edges of the board 51. Note that when the board 51 is in contact with the projections 58, it is also in contact with a fourth surface 62 among the inner peripheral surfaces 57 of the attaching portion 52 that is on the front side in the mounting direction of the case 41. The fourth surface 62 that comes into contact with a portion of the peripheral edges of the board 51 is continuous with the groove portion 54.

When the board 51 has been fitted into the attaching portion 52, it is positioned in the mounting direction of the case 41 due to being sandwiched between the projection 58 of the first surface 59 and the fourth surface 62 in the mounting direction. The board 51 is also positioned in the width direction of the case 41 due to being sandwiched between the projection 58 of the second surface 60 and the projection 58 of the third surface 61 in the width direction. In other words, when the board 51 has been fitted into the attaching portion 52, the attaching portion 52 positions the board 51 in the directions that extend along the attachment surface 53 (mounting direction and width direction) by coming into contact with portions of the peripheral edges of the board 51. Note that the upper portion of the projection 58 that protrudes from the first surface 59, which is one of the inner peripheral surfaces 57 of the attaching portion 52, has a tapered shape, thus achieving a configuration for facilitating the attachment of the board 51 to the attaching portion 52.

Also, the attaching portion 52 is provided with the extension portions 63 that are respectively continuous with the second surface 60 and the third surface 61 among the inner peripheral surfaces 57 of the attaching portion 52. The extension portions 63, which are portions of the case 41 (sub case 45) extend upward from the attachment surface 53 and oppose each other in the width direction of the case 41. Specifically, by being heat crimped while the board 51 is fitted in the attaching portion 52, the extension portions 63 deform into the protrusion portions 55 that cover portions of the upper surface of the board 51 accommodated in the attaching portion 52. When the protrusion portions 55 have been formed by heat crimping, the attachment of the board 51 to the attaching portion 52 is complete.

Figure 6:
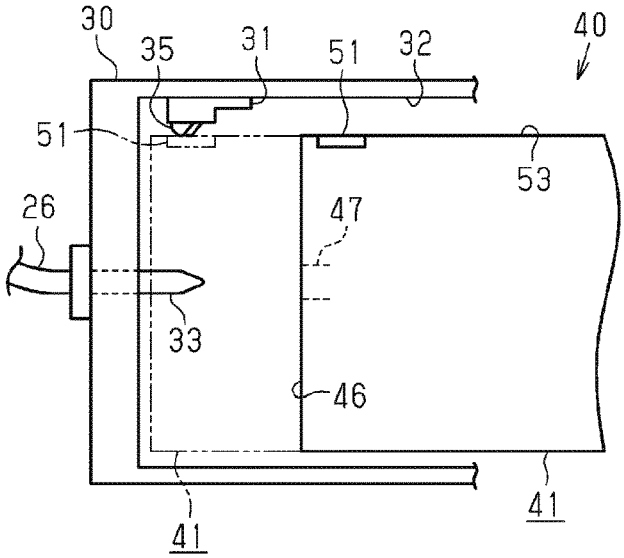
FIG. 6 is a side view schematically showing an aspect in which the ink cartridge is mounted to a mounting portion.
Figure 7:
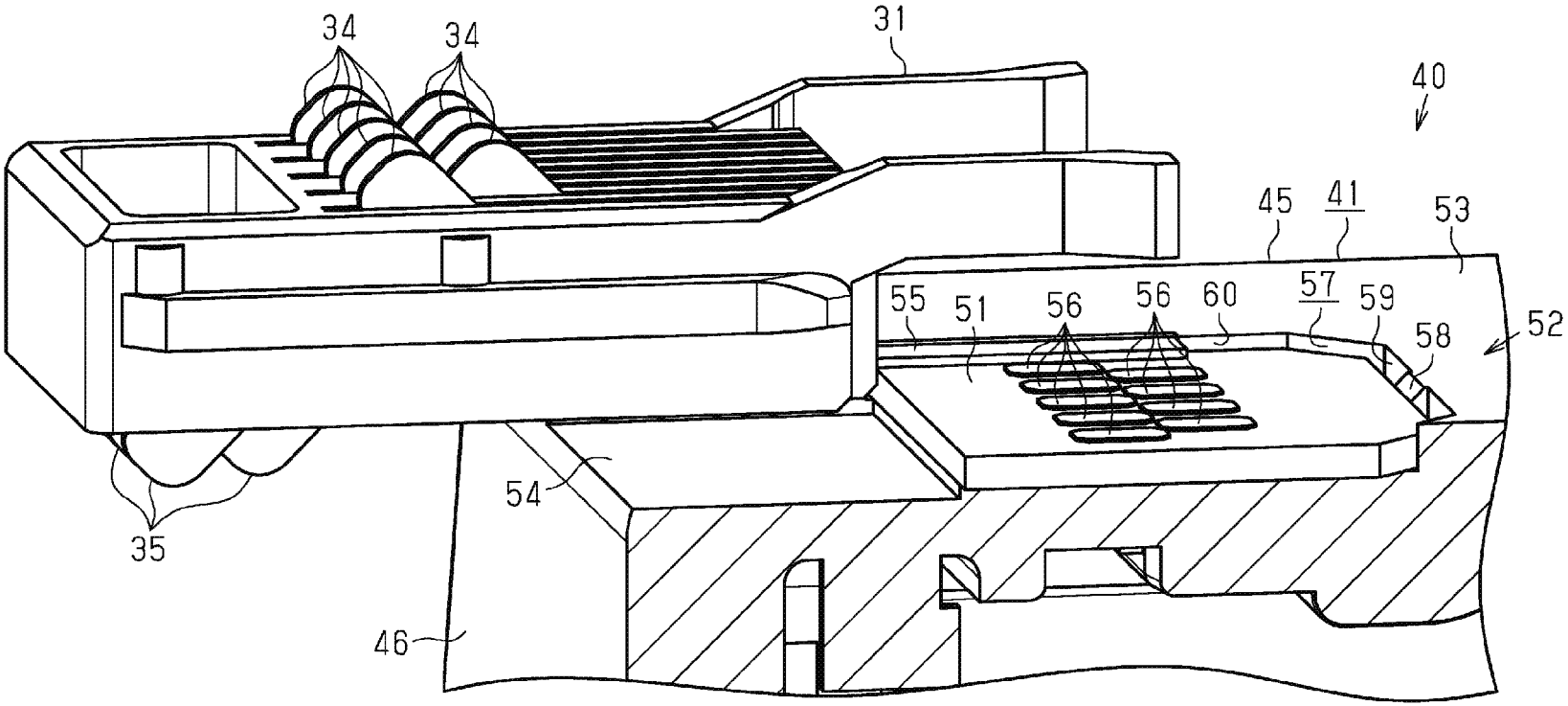
FIG. 7 is a perspective view of a cross-section of the ink cartridge and shows a terminal connection portion and the board.

As shown in FIGS. 6 and 7, in the mounting portion 30, the terminal connection portion 31 that can be electrically connected to the ink cartridge 40 is provided on a ceiling surface 32 of the mounting portion 30 that is on the back side in the space in which the case 41 of the ink cartridge 40 is mounted, that is to say on the front side in the mounting direction of the case 41. A feeding needle 33 for feeding ink from the ink cartridge 40 protrudes from the surface of the mounting portion 30 that opposes the front surface 46 of the case 41, and the feeding needle 33 is provided at the tip of the tube 26 that supplies the ink stored in the ink cartridge 40 to the head 22.

The terminal connection portion 31 provided on the ceiling surface 32 of the mounting portion 30 includes multiple apparatus-side contacts 34 that are approximately shaped as triangles that protrude upward, and multiple detachable body-side contacts 35 that are approximately shaped as upside down triangles that protrude downward. The apparatus-side contacts 34 and the detachable body-side contacts 35 are constituted by a material that has favorable conductivity such as a metal, and each apparatus-side contact 34 is put into conduction with a corresponding detachable body-side contact 35. Also, the apparatus-side contacts 34 and the detachable body-side contacts 35 are provided in a zigzag arrangement that is similar to the arrangement of the terminals 56 provided on the board 51.

The apparatus-side contacts 34 of the terminal connection portion 31 are in constant contact with terminals (not shown) of the printing apparatus 11, and when the detachable body-side contacts 35 come into contact with the terminals 56 of the board 51, the printing apparatus 11 can exchange various types of information with the ink cartridge 40 via the terminal connection portion 31. Specifically, when the case 41 is mounted to the mounting portion 30, the feeding needle 33 is inserted into the feeding hole 47 of the case 41 such that ink can be fed, and the detachable body-side contacts 35 of the terminal connection portion 31 come into contact with the terminals 56 of the board 51, thus realizing an electrical connection between the printing apparatus 11 and the ink cartridge 40.

Next, actions of the ink cartridge 40 having the above configuration will be described.

Figure 8:
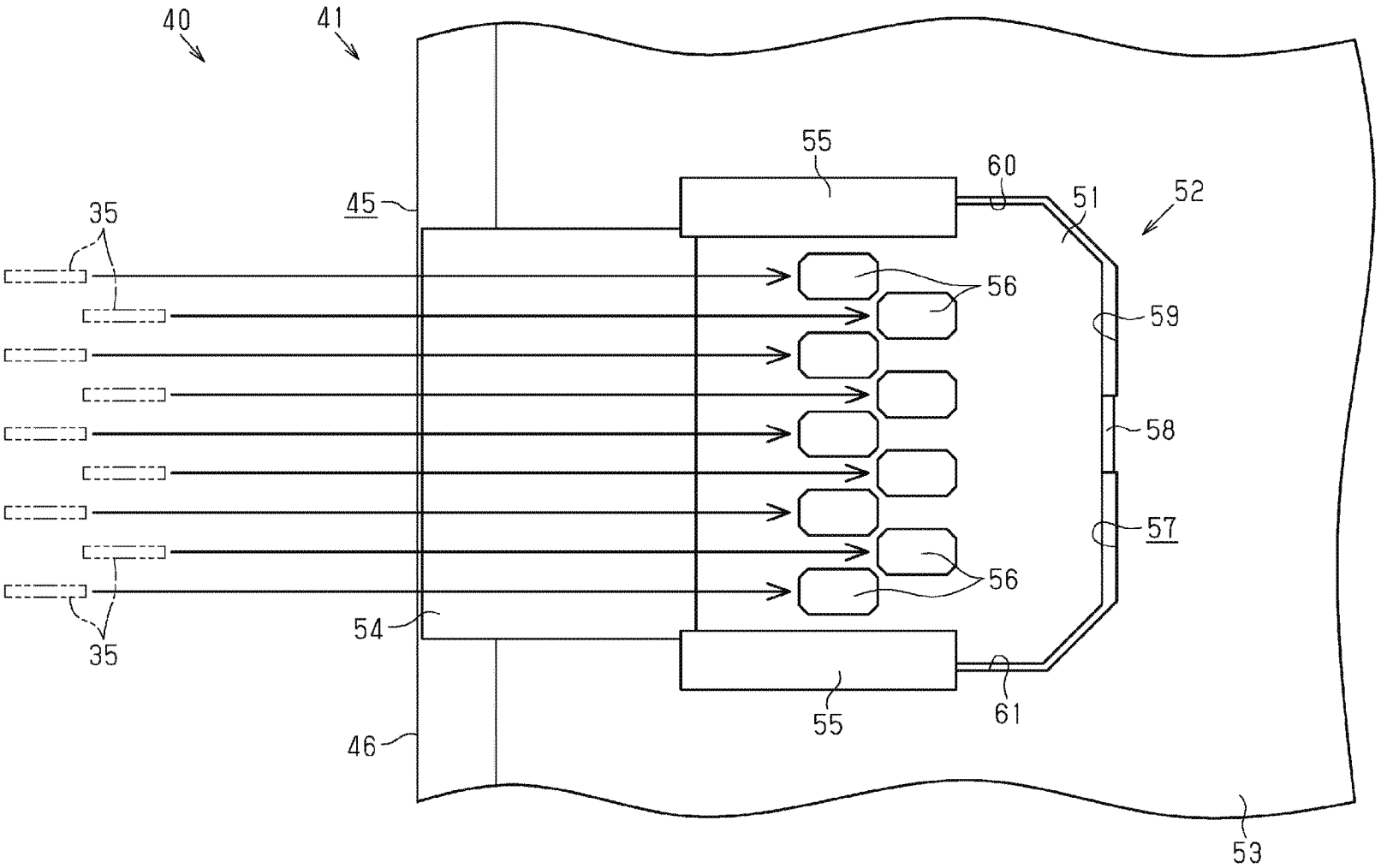
FIG. 8 is a top view of the attaching portion and shows an aspect in which the ink cartridge is mounted to the mounting portion.

As shown in FIGS. 7 and 8, when the case 41 of the ink cartridge 40 is mounted to the mounting portion 30, the case 41 moves along the mounting direction such that the detachable body-side contacts 35 of the terminal connection portion 31 move relative to the case 41 so as to move from the front surface 46 side of the case 41 toward the board 51. Normally, the terminal connection portion 31 is provided such that the detachable body-side contacts 35 are biased toward the terminals 56 of the board 51 in order to maintain a favorable state of contact with the terminals 56 of the board 51. The terminal connection portion 31 of this embodiment is constituted such that the tips of the detachable body-side contacts 35 are positioned lower than the upper surface of the board 51, that is to say overlap the upper surface of the board 51.

As shown in FIG. 8, when the case 41 is mounted to the mounting portion 30, the detachable body-side contacts 35 move relative to the case 41 and approach the board 51 along the paths indicated by arrows in FIG. 8. Specifically, the detachable body-side contacts 35 pass through the groove portion 54 provided in the attachment surface 53 of the case 41 and slide over the upper surface of the board until they reach a position of contact with the corresponding terminals 56 of the board 51.

In general, in a detachable body for a printing apparatus such as the ink cartridge 40 that is provided with the board 51 for exchanging information with the printing apparatus 11, it is common for the board 51 to be positioned by inserting a pin provided on the case 41 through the board 51 and then using heat crimping to deform the tip of the pin so as to have a brimmed shape, thus attaching the board 51. For this reason, in order to position the board 51, it is necessary to provide the board 51 with a through-hole, a notch, or the like for engaging with the pin, and it has therefore been necessary to perform processing on the board 51. Also, the portions of the case 41 that are subjected to heat crimping are likely to undergo abrasion due to deformation, and therefore there is a risk of such portions becoming worn away when coming into contact with the detachable body-side contacts 35 of the terminal connection portion 31, which are constituted by a hard material such as a metal, when the ink cartridge 40 is attached to the printing apparatus 11. If case 41 shavings are formed by coming into contact with the detachable body-side contacts 35 of the terminal connection portion 31, there is a risk of those shavings becoming affixed to the detachable body-side contacts 35 of the terminal connection portion 31 or the terminals 56 of the board 51 and causing a contact failure between the printing apparatus 11 and the ink cartridge 40.

In view of this, in the ink cartridge 40 of this embodiment, the board 51 is positioned by the attaching portion 52 provided so as to surround the board 51 coming into contact with the peripheral edges of the board 51. Also, the protrusion portions 55, which are provided by heat crimping portions of the case 41 (extension portions 63), lock the edges of the board 51 at positions that do no overlap the paths of relative movement of the detachable body-side contacts 35 during mounting, that is to say positions outward of the terminals 56 in the width direction of the case 41.

According to the above embodiment, effects such as the following can be obtained.

(1) By performing positioning by the attaching portion 52 coming into contact with peripheral edges of the board 51, the board 51 can be positioned in the case 41 without providing the board 51 with a through-hole or a notch. Accordingly, it is possible to position the board 51 that is to be electrically connected to the printing apparatus 11, while also reducing manufacturing cost.

(2) The board 51 can be positioned by merely fitting the board 51 into the attaching portion 52 that is a recessed portion. In other words, it is possible to improve the ease of attachment of the board 51 and reduce manufacturing cost.

(3) The projections 58 that protrude from the inner peripheral surfaces 57 of the attaching portion 52 position the board 51, thus making it possible to improve the ease of attachment of the board 51 in comparison with a configuration in which positioning is performed by the entirety of the inner peripheral surfaces 57 of the attaching portion 52 that is a recessed portion.

(4) In comparison with a configuration in which the attaching portion 52 is provided at a position toward the rear side in the mounting direction on the attachment surface 53, in the above embodiment, the attachment surface 53 of the case 41 comes into contact with the detachable body-side contacts 35 provided on the printing apparatus 11 over a shorter distance when the case 41 is mounted to the printing apparatus 11. In other words, it is possible to reduce the load when the case 41 is mounted to the printing apparatus 11.

(5) The risk of the board 51 falling out of the attaching portion 52 can be reduced by the protrusion portions 55.

(6) The protrusion portions 55 that lock the board 51 are provided at positions that do not overlap the paths of the detachable body-side contacts 35 that move relative to the mounting portion 30 when the case 41 is mounted to the mounting portion 30, thus making it possible to suppress the formation of case 41 shavings by coming into contact with the detachable body-side contacts 35. In other words, it is possible to suppress contact failure between the printing apparatus 11 and the ink cartridge.

Note that modifications to the above embodiment such as the following may be carried out. Also, the following examples of modifications to the above embodiment may be combined as appropriate.

Figure 9:
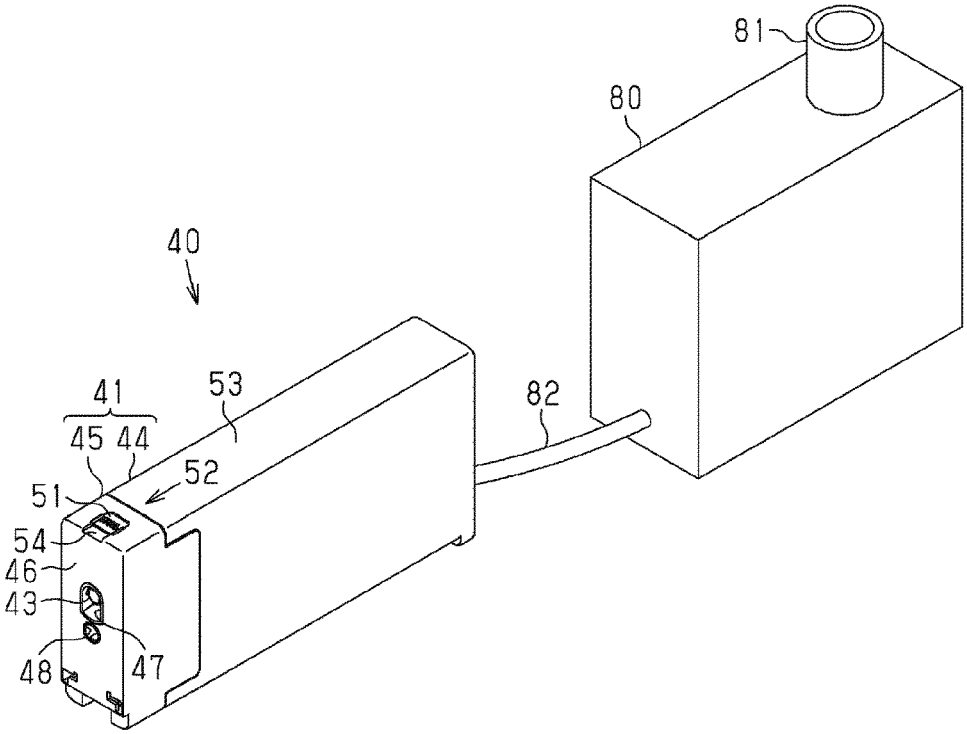
FIG. 9 is a perspective view of a relay member serving as an example of the detachable body for a printing apparatus.

As shown in FIG. 9, in the above embodiment, the ink cartridge 40 serving as a detachable body for a printing apparatus may be employed as a relay member for relay between the head 22 and a liquid storage container 80 that stores ink. The liquid storage container 80 has an injection port 81 into which ink can be injected, and the ink cartridge 40 that functions as a relay member is connected to the liquid storage container 80 via a tube 82. In other words, the ink stored in the liquid storage container 80 is supplied to the head 22 via the ink cartridge 40 that is provided as a relay member.

Figure 10:
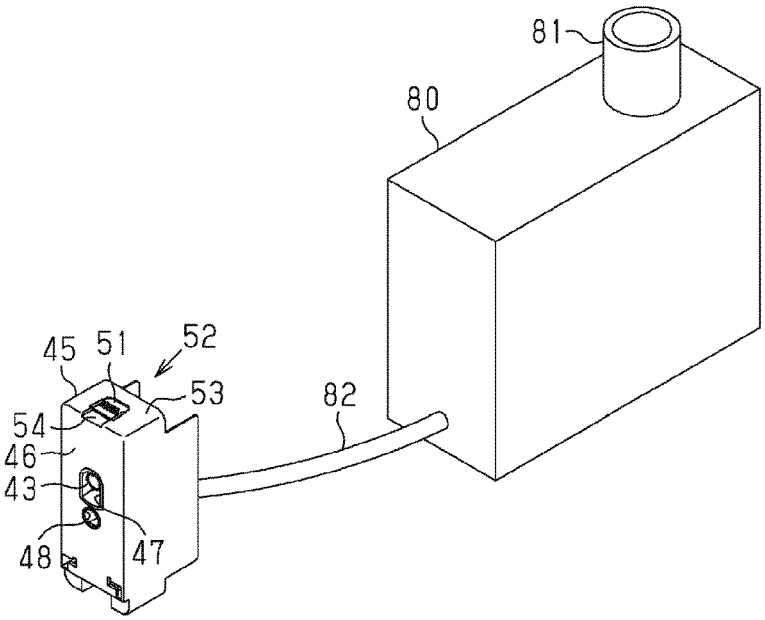
FIG. 10 is a perspective view of another relay member serving as an example of the detachable body for a printing apparatus.

Also, as shown in FIG. 10, a portion of the members that constitute the ink cartridge 40 may be employed as a relay member. This relay member includes the sub case 45 and the feeding portion 43. In this configuration, the tip of the tube 82 extending from the liquid storage container 80 is connected to the feeding portion 43 provided inside the sub case 45. Also, a configuration is possible in which the relay members shown in FIGS. 9 and 10 are installed in the carriage 17.

In the above embodiment, the detachable body for a printing apparatus having the above configuration is not limited to the ink cartridge 40 for storing ink that is to be supplied to the head 22. The detachable body for a printing apparatus may be a waste liquid storage body that stores ink suctioned by the maintenance unit 23 as waste liquid, for example. This waste liquid storage body exchanges information with the printing apparatus 11, such as the maximum amount of waste liquid that can be stored and the currently stored amount of waste liquid.

In the above embodiment, the ink cartridge 40 may have a configuration of being installed by being mounted to the carriage 17. In this case, the terminal connection portion 31 is provided inside the carriage 17.

In the above embodiment, the case 41 of the ink cartridge 40 is not required to have a configuration in which the main case 44 and the sub case 45 can be separated.

In the above embodiment, the attachment surface 53 of the ink cartridge 40 to which the board 51 is attached is not limited to being the upper surface of the case 41, and may be the lower surface or a side surface. The attachment surface 53 need only be a surface that extends along the mounting direction of the case 41.

In the above embodiment, the attaching portion 52 to which the board 51 is attached is not required to be a recessed portion that is recessed one level from the upper surface of the case 41. The attaching portion 52 may protrude upward from the attachment surface 53.

In the above embodiment, a configuration is possible in which the board 51 is provided at a position that is toward the rear side in the mounting direction in the case 41 of the ink cartridge 40.

In the above embodiment, there is no limitation to a configuration in which the board 51 is positioned by the projections 58 provided on the inner peripheral surfaces 57 of the attaching portion 52, and a configuration is possible in which the board 51 is positioned by the entirety of the inner peripheral surfaces 57, for example.

In the above embodiment, the groove portion 54 is not required to be provided. For example, a configuration is possible in which the attaching portion 52 surrounds all of the peripheral edges of the board 51.

In the above embodiment, a configuration is possible in which only one protrusion portions 55 is provided in the width direction of the case 41, and a configuration is possible in which the protrusion portion 55 locks the board 51 on the rear side thereof in the mounting direction of the case 41.

In the above embodiment, the protrusion portions 55 may protrude upward from the attachment surface 53.

In the above embodiment, the board 51 is not limited to being approximately rectangular, and may be triangular or circular for example.

In the above embodiment, the medium on which printing is performed by the printing apparatus 11, to which the ink cartridge 40 serving as the detachable body for a printing apparatus can be mounted to and detached from, is not limited to being a sheet P, and may be a piece of fabric a plastic film, or the like.

In the above embodiment, the printing apparatus 11 to and from which the ink cartridge 40 serving as a detachable body for a printing apparatus can be mounted and detached may be a fluid ejection apparatus that performs printing by ejecting or discharging a fluid other than ink (including a liquid, a liquid-like substance in which functional material particles are dispersed or mixed in a liquid, and a fluid-like substance such as a gel). Examples include a liquid-like substance ejection apparatus that performs printing by ejecting a liquid-like substance including a material such as an electrode material or a color material that is used for manufacturing a liquid crystal display, an EL (electroluminescence) display, a surface emission display, or the like, in the form of being dispersed or dissolved. Another example is a fluid-like substance ejection apparatus that ejects a fluid-like substance such as a gel (e.g., a physical gel). This invention can be applied to any one of these types of fluid ejection apparatuses. Note that the term "fluid" in this specification is a concept that excludes a fluid composed of only a gas, and includes a liquid (including an inorganic solvent, an organic solvent, a solution, a liquid resin, and a liquid metal (metal melt), etc.), a liquid-like substance, and a fluid-like substance, for example. In other words, the liquid stored by the ink cartridge 40 is not limited to being ink.

What is claimed is:

1. A detachable body for a printing apparatus, the detachable body comprising:

a case that is mounted to and detached from the printing apparatus, the case having a plurality of surfaces, the plurality of surfaces including first and second surfaces perpendicular to each other, ends of the first and second surfaces contacting each other at a first edge; and a circuit board that has a board terminal, the circuit board being disposed on the first surface of the case, the board terminal being electrically connected to a contact of the printing apparatus when the case is mounted to the printing apparatus, the circuit board being a solid member entirely devoid of any through-hole, wherein the first surface of the case has an attaching member to which the circuit board is attached, the attaching member contacts a peripheral edge of the circuit board so as to secure the circuit board to the first surface of the case, a first recess is provided in the first surface of the case from the first edge to the attaching member, wherein the attaching member is a second recess provided in the first surface of the case, and the peripheral edge of the circuit board is laterally enclosed by an inner peripheral wall of the second recess.

2. The detachable body for a printing apparatus according to claim 1, wherein a recess wall projection is provided on the inner peripheral wall of the second recess, and the projection laterally projects in a direction along the first surface of the case, and a tip of the projection physically contacts the peripheral edge of the circuit board.

3. The detachable body for a printing apparatus according to claim 2, wherein an attaching projection is provided at the attaching member, and the attaching projection is configured with first and second attaching projections, both ends of the first edge of the case are connected to second and third edges of the case, respectively, and the second and third edges configure sides of the first surface of the case, the first attaching projection is disposed at a first part of the attaching member closest to the second edge, and the second attaching projection is disposed at a second part of the attaching member closest to the third edge.

4. The detachable body for a printing apparatus according to claim 2, wherein a width of the attaching member in a width direction along the first edge is larger than a width of the first recess in the width direction.

5. The detachable body for a printing apparatus according to claim 2, wherein a depth of the second recess is smaller than a depth of the first recess so that a bottom step is formed between a bottom of the second recess and a bottom of the first recess.

6. The detachable body for a printing apparatus according to claim 1, wherein as the case moves relative to the printing apparatus in a mounting direction, the case is mounted to the printing apparatus, and the second surface and the first edge of the case are located at a proximal end in the mounting direction.

7. The detachable body for a printing apparatus according to claim 6, wherein an attaching projection is provided at the attaching member, and the attaching projection is configured with first and second attaching projections, both ends of the first edge of the case are connected to second and third edges of the case, respectively, and the second and third edges configure sides of the first surface of the case, the first attaching projection is disposed at a first part of the attaching member closest to the second edge, and the second attaching projection is disposed at a second part of the attaching member closest to the third edge.

8. The detachable body for a printing apparatus according to claim 6, wherein a width of the attaching member in a width direction along the first edge is larger than a width of the first recess in the width direction.

9. The detachable body for a printing apparatus according to claim 6, wherein a depth of the second recess is smaller than a depth of the first recess so that a bottom step is formed between a bottom of the second recess and a bottom of the first recess.

10. The detachable body for a printing apparatus according to claim 1, wherein an attaching projection is provided at the attaching member, and the attaching projection laterally protrudes in a direction along the first surface of the case to overhang the circuit board so as to partially cover an upper surface of the circuit board.

11. The detachable body for a printing apparatus according to claim 10, wherein an attaching projection is provided at the attaching member, and the attaching projection is configured with first and second attaching projections, both ends of the first edge of the case are connected to second and third edges of the case, respectively, and the second and third edges configure sides of the first surface of the case, the first attaching projection is disposed at a first part of the attaching member closest to the second edge, and the second attaching projection is disposed at a second part of the attaching member closest to the third edge.

12. The detachable body for a printing apparatus according to claim 10, wherein a width of the attaching member in a width direction along the first edge is larger than a width of the first recess in the width direction.

13. The detachable body for a printing apparatus according to claim 10, wherein a depth of the second recess is smaller than a depth of the first recess so that a bottom step is formed between a bottom of the second recess and a bottom of the first recess.

14. The detachable body for a printing apparatus according to claim 1, wherein an attaching projection is provided at the attaching member, and the attaching projection is configured with first and second attaching projections, both ends of the first edge of the case are connected to second and third edges of the case, respectively, and the second and third edges configure sides of the first surface of the case, the first attaching projection is disposed at a first part of the attaching member closest to the second edge, and the second attaching projection is disposed at a second part of the attaching member closest to the third edge.

15. The detachable body for a printing apparatus according to claim 1, wherein a width of the attaching member in a width direction along the first edge is larger than a width of the first recess in the width direction.

16. The detachable body for a printing apparatus according to claim 1, wherein a depth of the second recess is smaller than a depth of the first recess so that a bottom step is formed between a bottom of the second recess and a bottom of the first recess.

17. The detachable body for a printing apparatus according to claim 1, wherein the first and second surfaces extend in first and second directions, respectively, and the first and second directions are perpendicular to each other, the first edge extends in a third direction perpendicular to the first and second directions, the attaching member has a second recess provided in the first surface of the case, the first and second recesses are directly connected to each other, the first recess has a first inner peripheral wall and a first bottom, the second recess has a second inner peripheral wall and a second bottom, the second bottom is shallower than the first bottom, the first recess starts from the first edge and extends along the first direction, and the second recess starts from an end of the second recess and extends along the first direction, the peripheral edge of the circuit board contacts the second inner peripheral wall of the second recess so that the second recess of the attaching member secures the circuit board to the first surface of the case, and the first bottom of the first recess is exposed to an outside of the detachable body.

18. A detachable body for a printing apparatus, the detachable body comprising:

a case that is mounted to and detached from the printing apparatus, the case having a plurality of surfaces, the plurality of surfaces including first and second surfaces perpendicular to each other, ends of the first and second surfaces contacting each other at a first edge; and a circuit board that has a board terminal, the circuit board being disposed on the first surface of the case, the board terminal being electrically connected to a contact of the printing apparatus when the case is mounted to the printing apparatus, the circuit board being a solid member entirely devoid of any through-hole, wherein the first surface of the case has an attaching member to which the circuit board is attached, the attaching member contacts a peripheral edge of the circuit board so as to secure the circuit board to the first surface of the case, a first recess is provided in the first surface of the case from the first edge to the attaching member, and wherein a width of the attaching member in a width direction along the first edge is larger than a width of the first recess in the width direction.

* * * * *